United States Patent [19]

O'Halloran et al.

[11] 4,263,153

[45] Apr. 21, 1981

[54] OXAZOLINE CONTAINING DISPERSANTS STABILIZED AGAINST OXIDATION WITH SULFUR AND FUELS AND LUBRICANTS CONTAINING SAME

[75] Inventors: Rosemary O'Halloran, Union; Esther D. Winans, Colonia, both of N.J.

[73] Assignee: Exxon Research & Engineering Co., Florham Park, N.J.

[21] Appl. No.: 83,590

[22] Filed: Oct. 11, 1979

[51] Int. Cl.[3] ..... C01M 1/38

[52] U.S. Cl. ..... 252/475; 44/63; 44/76; 252/467; 252/402; 260/125; 260/128; 548/219; 548/225; 548/226; 548/237

[58] Field of Search ..... 252/47.5, 402, 46.7; 44/63, 76; 260/125, 128; 548/219, 225, 226, 237

[56] References Cited

U.S. PATENT DOCUMENTS

| | | | |
|---|---|---|---|
| 3,039,961 | 6/1962 | Harker | 252/47.5 |
| 3,200,107 | 8/1965 | LeSuer | 260/132 |
| 3,309,316 | 3/1967 | McNinch et al. | 252/47.5 |
| 3,357,990 | 12/1967 | Vineyard | 252/47.5 X |
| 3,390,086 | 6/1968 | O'Halloran | 252/47.5 |
| 3,470,098 | 9/1969 | O'Halloran | 252/47.5 |
| 3,600,327 | 8/1971 | Hu | 252/47.5 X |
| 3,682,948 | 8/1972 | Tomalia | 548/237 |
| 4,028,258 | 6/1977 | Kablaoui et al. | 252/46.7 |
| 4,049,564 | 9/1977 | Ryer et al. | 252/51.5 A |
| 4,062,786 | 12/1977 | Brois et al. | 252/51.5 R |
| 4,102,798 | 7/1978 | Ryer et al. | 252/51.5 A |
| 4,113,639 | 9/1978 | Lonstrup et al. | 252/51.5 A |
| 4,157,243 | 6/1979 | Ryer et al. | 44/63 |
| 4,161,475 | 7/1979 | Davis | 252/47.5 X |

FOREIGN PATENT DOCUMENTS

| | | | |
|---|---|---|---|
| 1483681 | 8/1977 | United Kingdom | 252/51.5 A |

*Primary Examiner*—Andrew Metz

*Attorney, Agent, or Firm*—Frank T. Johmann; John J. Mahon

[57] ABSTRACT

A dispersant or dispersant mixture that is useful in fuel and lubricant compositions, and that is characterized by its derivation from a long chain dicarboxylic acid material and an amino alcohol, is stabilized against oxidation by sulfurization by reaction with sulfur or with a sulfur compound selected from the group consisting of carbon disulfide, sulfides of phosphorus including $P_2S_5$ and $P_4S_3$, and phosphosulfurized olefins. More particularly, the dispersant so treated will usually comprise a mono or bis-oxazoline prepared by reaction of a hydrocarbyl-substituted $C_4$–$C_{10}$ dicarboxylic acid or anhydride or ester thereof, having at least 50 carbon atoms in the hydrocarbyl group, with a 2,2-disubstituted 2-amino-1-alkanol that has from two to three hydroxy groups and that contains from 4 to 8 total carbon atoms.

9 Claims, No Drawings

OXAZOLINE CONTAINING DISPERSANTS STABILIZED AGAINST OXIDATION WITH SULFUR AND FUELS AND LUBRICANTS CONTAINING SAME

FIELD OF THE INVENTION

This invention relates to the stabilization of certain dispersant additives against oxidation by sulfurization by reaction of those dispersants with elemental sulfur or with certain compounds of sulfur, particularly with compounds containing both phosphorus and sulfur. The dispersants that are thus stabilized are of the type that comprise mono or bis-oxazolines of a dicarboxylic acid moiety that have been prepared by reaction of a hydrocarbyl-substituted $C_4$–$C_{10}$ dicarboxylic acid or anhydride or ester thereof that has at least 50 carbon atoms in the hydrocarbyl group, with a 2,2-disubstituted 2-amino-1-alkanol that has from two to three hydroxy groups and that contains from 4 to 8 total carbon atoms. Dispersants of this type are particularly useful in lubricating oil compositions that are intended for automotive crankcases or as working fluids in automatic transmissions, e.g. ATF compositions.

In the present invention the dispersants referred to are reacted with elemental sulfur or with a sulfur compound selected from the group consisting of carbon disulfide, a sulfide of phosphorus or a phosphosulfurized olefin.

REFERENCE TO PRIOR DISCLOSURES

Dispersants that can be treated with elemental sulfur or with a sulfur-containing compound of the type mentioned, in accordance with the present invention, i.e. an oxazoline reaction product of a high molecular weight dicarboxylic acid or anhydride or ester with a 2,2-disubstituted 2-amino-1-alkanol, are described in U.S. Pat. Nos. 4,102,798; 4,113,639; 4,049,564 and U.K. Pat. No. 1,483,681.

U.S. Pat. No. 3,390,086 of Rosemary O'Halloran teaches the treatment of certain high molecular weight nitrogen-containing derivatives of carboxylic acids and anhydrides with sulfur to improve thermal stability. The dispersants that are so sulfurized are mineral-oil-soluble amides or imides of polyalkylene-amines and carboxylic acids or anhydrides.

U.S. Pat. No. 3,470,098 of the same inventor, and related to U.S. Pat. No. 3,390,086, teaches the similar treatment of the mentioned dispersants with sulfur chlorides.

U.S. Pat. No. 4,062,786 of Stanley Brois and Antonio Gutierrez teaches sludge dispersants and anti-rust additives for oleaginous compositions comprising lactone oxazoline reaction products of hydrocarbon-substituted lactone carboxylic acids with 2,2-disubstituted 2-amino-1-alkanols. The lactone oxazoline products can contain thiyl, sulfoxide, sulfide, sulfone or sulfo groups.

U.S. Pat. No. 3,309,316 of Herbert McNinch and Robert Karll describes the preparation of an ashless low-corrosivity detergent for lubricating oil formulations by reacting an alkenyl substituted succinic anhydride with sulfur and then with an amine, preferably with a polyalkylene polyamine.

U.S. Pat. No. 3,200,107 of William LeSuer teaches a process for preparing a multifunctional additive for hydrocarbon compositions wherein an alkylene polyamine is reacted with carbon disulfide and with a hydrocarbon-substituted dicarboxylic acid or its anhydride wherein the hydrocarbon substituent has at least 12 carbon atoms. The product contains both nitrogen and sulfur and possesses antioxidant, detergent and corrosion-inhibiting properties.

In U.S. Pat. No. 4,028,258 of M. S. Kablaoul et al there is disclosed an automatic transmission fluid containing an alkylene oxide adduct of a phosphosulfurized N-(hydroxyalkyl) alkenyl succinimide, the adduct being prepared by reacting an alkenyl succinic anhydride with phosphorus pentasulfide, then with an alkylene oxide and finally with an alkanolamine.

DESCRIPTION OF THE INVENTION

In recent years oil-soluble ashless sludge dispersing additives have attained increasing importance for use in fuel and lubricating oil compositions. Such dispersants must not only perform their intended function properly but should also be stable against oxidation or other deterioration and should not be corrosive to copper or other metals that may be present in the system in which the composition is being used.

One type of ashless dispersant that has been found to be particularly useful and that has been widely adopted for lubricant and fuel compositions can be broadly referred to as one that comprises an amine or polyamine that is attached to a long hydrocarbon chain through an acid group. Among the various types of dispersants of this nature are those that are derived from long chain monocarboxylic acids, long chain dicarboxylic acids, or dicarboxylic acid lactones, and from polyamines, hydroxy amines, and polyols plus amines. See for example the first two columns of U.S. Pat. No. 4,062,786 referred to above.

The present invention is directed to the improvement of the type of ashless sludge dispersant that comprises a mono or bis-oxazoline obtained by reaction of a hydrocarbyl-substituted $C_4$–$C_{10}$ dicarboxylic acid material, i.e. the $C_4$–$C_{10}$ dicarboxylic acid, or anhydride or ester thereof, that has at least 50 carbon atoms in the hydrocarbyl group, with about one to two moles per mole of dicarboxylic acid moiety, of a 2,2-disubstituted 2-amino-1-alkanol that has from 2 to 3 hydroxy groups and that contains from 4 to 8 total carbon atoms.

The hydrocarbyl-substituted dicarboxylic acid materials of the types mentioned above are now generally known in the art and can be prepared by reaction of an unsaturated dicarboxylic acid material, typically maleic anhydride, with an olefinic material, usually an olefin polymer that still retains a terminal unsaturation, e.g. polyisobutylene having about 60 carbon atoms in the molecule. Frequently the olefin polymer is first chlorinated or brominated prior to reaction with the dicarboxylic acid material. See for example U.S. Pat. No. 3,444,170. See also U.S. Pat. Nos. 3,172,892, 3,219,666 and 3,272,746. Examples of the $C_4$–$C_{10}$ monoethylenically unsaturated dicarboxylic acid material that is reacted with the olefinic material include maleic acid, maleic anhydride, fumaric acid, chloromaleic acid, dimethyl fumarate, etc. Preferably the olefinic material is a polymer of primarily a $C_2$ to $C_5$ monoolefin such as ethylene, propylene, butylene, isobutylene or pentene. Polyisobutylene is generally preferred. The polymers will ordinarily have at least about 50 carbons average and number average molecular weights within the range of about 700 to about 200,000. Usually where the sulfurized oxazoline product is to be used as a dispersant, the molecular weight of the olefin polymer will be low, e.g. about 700 to 10,000, more usually about 700 to 5000, preferably 800 to 3000. The higher molecular weight olefin polymer, either with or without terminal unsaturation, will be used when the final product is a V.I.-dispersant type additive. Usually about 10,000 to 200,000, preferably about 20,000 to 100,000 number average molecular weight olefin polymers are then used, such as ethylene-propylene polymers or terpolymers of ethylene-propylene and a diene such as 5-ethylene-2-norbornene as is known in the art. Then, the high molecular weight polymer is derivatized to add a number of acid functions, e.g. succinic acid functions on the polymer as shown for example, by U.S. Pat. No. 4,089,794, which grafts multiple maleic anhydride units onto such a high molecular weight ethylene-propylene polymer, which acid functions then react to give the oxazoline structures.

The amino alcohol that is used to prepare the oxazoine is a 2,2-disubstituted 2-amino 1-alkanol having 2 to 3 hydroxy groups and containing a total of 4 to 8 carbon atoms. This amino alcohol can be represented by the formula:

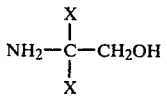

wherein X is an alkyl or hydroxyalkyl group with the alkyl groups having from 1 to 3 carbon atoms wherein at least one, and preferably both, of the X substituents is a hydroxyalkyl group of the structure—$(CH_2)_nOH$, n being 1 to 3. Examples of such amino alcohols include: 2-amino-2-methyl-1,3 propanediol; 2-amino-2-ethyl-1,3-propanediol; and 2-amino-2-(hydroxymethyl)-1,3-propanediol, the latter also being known as THAM, or tris (hydroxymethyl) amino methane. THAM is particularly preferred because of its effectiveness, availability and low cost. The oxazolines, e.g. the bis-oxazolines (which are preferred) can be prepared in good yields by reaction of about two moles of the amino alcohol with one mole of the dicarboxylic acid material at 140° to 220° C. while removing three moles of water. A corresponding one to one mole ratio will give the mono-oxazoline which can be sulfurized as is, or the remaining carbonyl group can be further reacted with amines, polyamines, e.g. polyethylene amines, polyols, alkylene oxides as described in U.S. Pat. No. 4,049,564 before being sulfurized by reaction with the sulfur material.

While the oxazolines of the type described are very effective dispersants for sludge and other contaminants that develop in oil compositions a problem has sometimes arisen in their use in that, under some conditions, oxidation can cause the dispersants to be somewhat corrosive to copper or its alloys. In one such instance where a bis-oxazoline dispersant of the type described was employed in an automatic transmission fluid formulation that was being tested, it was found that due to oxidation the oil cooler braze joints tended to corrode, causing engine coolant in the automotive radiator to leak into the transmission fluid cooling lines. The oxidation problem was solved by treating the bis-oxazoline dispersant with elemental sulfur or with phosphosulfurized pinene, phosphorus pentasulfide or carbon disulfide, in accordance with the present invention.

In the practice of the present invention the oxazoline is sulfurized, i.e reacted with elemental sulfur or with carbon disulfide, a sulfide or phosphorus or a phosphosulfurized olefin, usually at a temperature in the range of about 100° to 300° C., preferably 150° C. to about 200° C. for from a time in the range of about one to 20 hours, usually about one to about five hours, in such proportions as to impart about 0.3 wt. % to 7 wt. %, e.g. 0.5 to 3 wt. % of sulfur into the oxazoline based on the weight of the oxazoline compound. Typically after the reaction has proceeded for a period of time, say ½ to 1 hour, a stream of inert gas such as nitrogen can be bubbled through the reaction mixture to remove unwanted volatile products or unreacted sulfur compounds while the reaction continues, or the gas bubbling can be initiated at the start of the reaction.

The phosphosulfurized olefinic material is preferably a phosphosulfurized terpene, more preferably phosphosulfurized alpha pinene. Other suitable phosphosulfurized olefins comprise polymers of $C_2$–$C_5$ olefins such as ethylene, propylene, butene, isobutene or pentene, of from about 500 to about 50,000 preferably 500 to 3000 number average molecular weight that have been reacted with a sulfide or phosphorus, e.g. polyisobutene of about 1800 molecular weight treated with $P_2S_5$. To phosphosulfurize an olefin it is treated with $P_2S_3$, $P_2S_5$, $P_4S_7$ or the like, preferably $P_2S_5$, under anhydrous conditions at a temperature within the range of about 80° C. to about 300° C. for from about 30 minutes to about 15 hours, more usually from about 2 to about 8 hours, in the proportion of about 5 to about 40 wt. % of sulfide of phosphorus based on the olefin.

The sulfurized oxazolines of the present invention are employed in lubricating oil compositions, e.g. mineral lubricating oil in concentrations ranging from about 0.01 to about 20 wt. %, preferably from about 0.1 wt. % to about 5 wt. % of the total composition, when such compositions are primarily lubricants or working fluids such an automotive crankcase lubricants or automatic transmission fluids. Ordinarily when the additives are to be employed in normally liquid hydrocarbon fuels such as fuel oil, gasoline, kerosene and the like, concentrations will range from about 0.001 to about 2 wt. % based on the total composition.

The invention will be further understood by reference to the following examples, which include preferred embodiments of the invention.

EXAMPLE 1

In a stainless steel vessel 296 grams of a bis-oxazoline concentrate was heated to 177° C. (350° F.). Then over a period of one hour while the temperature was not changed there was added gradually 6 grams of elemental sulfur. Thereafter for about two hours a stream of nitrogen was slowly bubbled through the reaction mixture at 177° C. The final product was found by analysis to contain 2.02 wt. % S. The bis-oxazoline concentrate used in this preparation was prepared as described in British patent specification No. 1,483,681 from polyisobutenyl succinic anhydride having a polyisobutenyl group of about 1000 number average molecular weight and from THAM (tris(hydroxymethyl) amino methane), and was in the form of a concentrate of about 50 wt. % of the bis-oxazoline in about 50 wt. % light solvent neutral mineral oil. The bis-oxazoline is conveniently referred to as PIBSA-THAM, and the sulfurized bis-oxazoline product as S-PIBSA-THAM.

EXAMPLE 2

After 288 grams of the bis-oxazoline concentrate described in Example 1 had been heated to 177° C. in a stainless steel vessel there was added over a period of about one hour at the same temperature 12 grams of $P_2S_5$. Then, with the temperature being held at 160°–177° C. a stream of nitrogen was bubbled slowly through the mixture for 90 minutes and then for an additional 45 minutes while the temperature was lowered to about 55° C. (130° F.). The mixture was then dissolved in heptane and filtered through Celite filter aid and the heptane was stripped off by heating, leaving a reaction product concentrate which analyzed 1.26 wt. % sulfur. The product is conveniently called $P_2S_5$-PIBSA-THAM.

EXAMPLE 3

After 300 grams of the bis-oxazoline concentrate described in Example 1 had been heated to 150° C. (300° F.) in a stainless steel vessel, there was added to it, all at one time, 60 grams of an oil concentrate phosphosulfurized alpha pinene. Then while a stream of nitrogen was introduced into the mixture the temperature was increased to 177° C. (350° F.) and nitrogen bubbling was continued at that temperature for 3 hours. The final reaction product, which can be called $P_2S_5$-pinene-PIBSA-THAM, had a sulfur content of 1.96 wt. %.

The oil concentrate of the phosphosulfurized alpha pinene contained about 13 wt. % sulfur and about 5 wt. % phosphorus based on the total weight of the oil concentrate. A typical laboratory preparation of said oil concentrate of phosphosulfurized alpha pinene is by adding 575 g. of alpha pinene with 400 g. of Solvent 150 Neutral mineral lubricating oil to a flask, heating to 122° C. while sparging with nitrogen, adding 222 g. of $P_2S_5$ over about one hour while maintaining the temperature between about 122°–138° C., soaking at 138° C. for one hour, heating to 150° C. and holding for an hour, then cooling to 138° C. and stripping under vacuum (a pressure of 600 mm. Hg.) to obtain the oil concentrate.

EXAMPLE 4

A mixture of 10 grams of carbon disulfide and 65 grams of the bis-oxazoline concentrate of Example 1 was placed in a pressure vessel which was then sealed and immersed in an oil bath at 170° C. and held there for 3 hours. Thereafter the pressure vessel was removed from the oil bath, cooled and opened; then the contents were sparged with nitrogen at 120° C. to remove any unreacted carbon dilsufide that might be present. Analysis of the product ($CS_2$-PIBSA-THAM) showed 2.54 wt. % sulfur.

EXAMPLE 5

A number of test blends were prepared using the reaction products described in Examples 1 through 4 above, and, in addition, a blend of the untreated bis-oxazoline described above, and a blend containing a mixture of phosphosulfurized alpha pinene and the bis-oxazoline rather than the reaction product of Example 3. Each of these test blends was subjected to a test known as the Laboratory Multiple Oxidation Test (LMOT). In the LMOT test a 40 gram sample of the oil blend to be tested is prepared for the test by adding to it 2 grams of powdered iron and 100 parts per million of copper as copper naphthenate. The prepared sample is then heated to 300° F. and maintained at that temperature while air is continuously blown through it at the rate of 25 ml per minute. At the end of each 24 hours a drop of the oil is withdrawn and placed on a piece of blotting paper or filter paper and the latter is visually examined for sludge. The test is terminated when sludge appears as a definite dark spot on the filter paper, and the oxidation stability of the oil is rated by the number of days to sludge formation.

In Table I which follows are shown the dispersants used in each of the LMOT tests, which dispersants were concentrates of about 50 wt. % active ingredient in 50 wt. % oil, the sulfur content (based on the weight of concentrate) of each of the dispersants used, and the days to sludge formation for each blend. In addition to the LMOT test each blend was also tested for copper corrosion by immersing a 4 gram copper strip in each blend for 3 days at 300° F. and measuring the weight loss. These test results are also shown in the table. Each test blend was prepared by simple mixing of 2 wt. % of the respective dispersant concentrate, 0.3 wt. % of dioctyl diphenyl amine (a conventional antioxidant for lube oil) and 97.7 wt. % of solvent refined neutral mineral lubricating oil having a viscosity of 100 SUS at 100° F.

TABLE I

Results of Oxidation and Corrosion Tests

| 2% Disp. Conc. In Test Blend | Sulfur Content of Disp. Conc. Wt. % | LMOT Results Days to Sludge | 3 Day Copper Loss, mg. |
|---|---|---|---|
| PIBSA-THAM | 0 | <3 | 1.3 |
| S-PIBSA-THAM (Ex. 1) | 2.0 | 3.5 | 0.2 |
| $P_2S_5$-PIBSA-THAM (Ex. 2) | 1.3 | 5 | 1.4 |
| $P_2S_5$-Pinene-PIBSA-THAM (Ex. 3) | 2.0 | 4.5 | 1.2 |
| Mixed $P_2S_5$-Pinene and | 2.6 | <3 | 0.2 |
| $CS_2$-PIBSA-THAM (Ex. 4) | 2.5 | 5 | 3.0 |

*Simple mixture of 5 parts by weight PIBSA-THAM and 1 part by weight of the phosphosulfurized alpha pinene described in Example 3 (total 2 wt. %) plus 0.2 parts by weight of the dioctyl diphenyl amine in 97.7 parts by weight of mineral lubricating oil.

As the data in Table I show, treatment of the PIBSA-THAM, i.e. the bis-oxazoline dispersant with sulfur, with $P_2S_5$, with phosphosulfurized pinene, and with carbon disulfide, in accordance with the present invention, in each instance improved the oxidation stability of the dispersant. At the same time the treatment did not impair the corrosion inhibiting properties of the dispersant. It will also be noted that merely mixing the bis-oxazoline and the phosphosulfurized alpha pinene rather than reacting them together did not improve oxidation stability.

EXAMPLE 6

A fully formulated fluid composition suitable for use as an automatic transmission fluid is prepared by simple mixing of 3 wt. % of polystyrene-polymethacrylate V.I. improver of about 126,000 number average molecular weight, 0.3 wt. % of dioctyl diphenyl amine, 0.1 wt. % of overbased magnesium hydrocarbyl sulfonate (total base number 300; hydrocarbyl group of about 950 mol. wt.), 0.4 wt. % of dihexyl phthalate, 0.1 wt. % tridecyl alcohol as a seal swellant, and 3.6 wt. % of the reaction product of Example 3, in a solvent refined neutral lubricating oil of viscosity 100 SUS at 100° F., all percentages being based on the total composition.

What is claimed is:

1. A process for improving the oxidation stability of an oxazoline or bis-oxazoline dispersant prepared by the reaction of a hydrocarbyl substituted $C_4$–$C_{10}$ dicarboxylic acid, anhydride or ester thereof that has at least 50 carbon atoms in the hydrocarbyl group with a 2,2-disubstituted 2-amino-1-alkanol that has from 2 to 3 hydroxy groups and that contains from 4 to 8 total carbon atoms, which process comprises reaction of said dispersant with elemental sulfur or with a sulfur compound selected from the group consisting of carbon disulfide, a sulfide of phosphorus or a phosphosulfurized olefin, said reaction being carried out at about 100° to 300° C. in a mineral oil solution consisting essentially of said mineral oil, said dispersant and said sulfur or sulfur compound to incorporate from about 0.5 wt. % to about 5 wt. % of sulfur into said dispersant.

2. The process of claim 1 wherein said dispersant is a bis-oxazoline, said disubstituted amino alcohol is tris-(hydroxymethyl) amino methane, and said reaction with sulfur or sulfur compound is carried out at about 150° to 200° C. for about one to five hours.

3. The process of claim 1 wherein the $C_4$–$C_{10}$ dicarboxylic acid, anhydride or ester is a hydrocarbyl succinic acid anhydride which the hydrocarbyl portion is obtained from a $C_2$–$C_5$ monoolefin polymer of from about 750 to about 200,000 number average molecular weight.

4. The process of claim 3 wherein the olefin polymer comprises polyisobutylene of about 1000 to 3000 molecular weight.

5. The process of claim 1 wherein said sulfur compound comprises phosphorus pentasulfide.

6. The process of claim 1 wherein said sulfur compound comprises phosphosulfurized alpha pinene.

7. The improved dispersant prepared by the process defined by claim 1.

8. An oil composition comprising a major proportion of a hydrocarbon fuel or hydrocarbon lubricating oil into which has been incorporated from about 0.01 to about 20 wt. % of an improved bis-oxazoline dispersant prepared by the process of claim 1.

9. In an automatic transmission fluid comprising a major proportion of an oil of lubricating viscosity and conventional automatic transmission fluid additives in amounts sufficient to provide their attendant function, the improvement comprising that the automatic transmission fluid further contains from about 0.1 to about 5 wt. % of the improved bis-oxazoline dispersant prepared by the process of claim 1.

* * * * *